US006439267B2

(12) United States Patent
Welker

(10) Patent No.: US 6,439,267 B2
(45) Date of Patent: Aug. 27, 2002

(54) ADJUSTABLE FLOW DIFFUSER

(75) Inventor: Robert H. Welker, Washington, TX (US)

(73) Assignee: Welker Engineering Company, Sugar Land, TX (US)

( * ) Notice: Subject to any disclaimer, the term of this patent is extended or adjusted under 35 U.S.C. 154(b) by 0 days.

(21) Appl. No.: 09/895,117

(22) Filed: Jun. 29, 2001

Related U.S. Application Data

(63) Continuation-in-part of application No. 09/360,424, filed on Jul. 23, 1999, now Pat. No. 6,289,934.

(51) Int. Cl.[7] ..... F15D 1/00

(52) U.S. Cl. ..... 138/39; 138/43; 138/46; 137/625.28; 251/118

(58) Field of Search ..... 138/37, 39, 43, 138/46; 251/118, 126, 127; 137/625.28, 625.3, 625.38

(56) References Cited

U.S. PATENT DOCUMENTS

| | | | | |
|---|---|---|---|---|
| 1,539,465 | A | | 5/1925 | Schurtz |
| 1,570,907 | A | | 1/1926 | McKee |
| 2,198,730 | A | | 4/1940 | Kadenacy |
| 3,157,200 | A | | 11/1964 | Rowan |
| 3,170,483 | A | | 2/1965 | Milroy |
| 3,207,484 | A | | 9/1965 | Rubin |
| 3,271,845 | A | | 9/1966 | Breher |
| 3,451,404 | A | | 6/1969 | Self |
| 3,602,261 | A | | 8/1971 | Brown et al. |
| 3,602,262 | A | | 8/1971 | Henden |
| 3,630,229 | A | | 12/1971 | Nagel et al. |
| 3,776,278 | A | | 12/1973 | Allen |
| 3,917,222 | A | | 11/1975 | Kay et al. |
| 3,920,044 | A | | 11/1975 | Gruner |
| 3,990,475 | A | | 11/1976 | Myers |
| 4,022,423 | A | | 5/1977 | O'Connor et al. |
| 4,068,683 | A | | 1/1978 | Self |
| 4,085,774 | A | | 4/1978 | Baumann |
| 4,150,696 | A | * | 4/1979 | Meier et al. ..... 138/46 |
| 4,271,866 | A | * | 6/1981 | Bey ..... 137/625.3 |

(List continued on next page.)

FOREIGN PATENT DOCUMENTS

| | | |
|---|---|---|
| DE | 28 10 118 | 9/1979 |
| EP | 0 097 312 | 1/1984 |
| JP | 59140973 | 8/1984 |

OTHER PUBLICATIONS

Fisher Controls; "High Performance Control"; 1989; pp. 1–12.

Fisher–Rosemount; "Type 399A Pilot–Operated Pressure Reducing Regulator"; Bulletin 71.2:399A–161; pp. 1–24, 1992.

Fisher–Rosemount; "Whisper Trim I Cage"; Bulletin 80.1:006; Mar. 1997; p. 1.

Fisher–Rosemount; "Whisper Trim III Cages"; Bulletin 80.1:010; Mar. 1997; pp. 1–4.

Fisher–Rosemount; "WhisperFlo Trim"; Dec. 1997; pp. 1–10.

Fisher–Rosemount; "WhisperFlo Aerodynamic Attenuation Trims"; Bulletin 80.3: 010; Feb. 1999; pp. 1–4.

(List continued on next page.)

*Primary Examiner*—James Hook

(74) *Attorney, Agent, or Firm*—Blackwell Sanders Peper Martin, LLP

(57) ABSTRACT

When a fluid passes through a conventional elbow, turbulence is created in the fluid flow. The fluid may not stabilize and return to a laminar flow until 40–50 pipe diameters downstream. Turbulence in a piping system can cause a variety of problems such as measurement error, noise, vibration, and/or erosion. The flow diffuser of the present invention may be configured as a 90° elbow for use in a piping system to reduce turbulence and/or pulsation as the fluid passes through the improved elbow. The elbow can restore substantially laminar flow in a space of about four pipe diameters, with nominal pressure drop.

21 Claims, 9 Drawing Sheets

U.S. PATENT DOCUMENTS

| | | | | | |
|---|---|---|---|---|---|
| 4,279,274 | A | | 7/1981 | Seger | |
| 4,295,487 | A | * | 10/1981 | Purton | 137/625.3 |
| 4,295,493 | A | * | 10/1981 | Bey | 138/46 |
| 4,328,832 | A | * | 5/1982 | Inada et al. | 138/46 |
| 4,436,481 | A | * | 3/1984 | Linder | 138/37 |
| 4,473,210 | A | | 9/1984 | Brighton | |
| RE32,197 | E | | 7/1986 | Self | |
| 4,614,440 | A | | 9/1986 | King | |
| 4,729,407 | A | * | 3/1988 | Lew | 137/625.28 |
| 4,758,098 | A | | 7/1988 | Meyer | |
| 4,929,088 | A | | 5/1990 | Smith | |
| 5,014,746 | A | | 5/1991 | Heymann | |
| 5,070,909 | A | | 12/1991 | Davenport | |
| 5,074,333 | A | | 12/1991 | Martin | |
| 5,307,830 | A | | 5/1994 | Welker | |
| 5,402,821 | A | * | 4/1995 | Harstad | 138/46 |
| 5,454,640 | A | | 10/1995 | Welker | |
| 5,730,416 | A | | 3/1998 | Welker | |
| 5,769,388 | A | | 6/1998 | Welker | |
| 6,158,412 | A | * | 12/2000 | Kim | 138/39 |
| 6,250,330 | B1 | * | 6/2001 | Welker | 137/625.3 |
| 6,289,934 | B1 | * | 9/2001 | Welker | 138/39 |

OTHER PUBLICATIONS

Pipe Line & Gas Industry magazine; "New gas–pressure regulator blends features of boots, plugs"; May 1999; pp. 59–71.

Fisher–Rosemount; "Type EZR Pressure Reducing Regulator"; Bulletin 71.2: EZR Jan. 1999; pp. 1–24.

Fisher Controls; "Cavitrol V Trim"; Bulletin 80.2: 020; May 1979; pp. 1–4.

Fisher–Rosemount; "Cavitrol III One–Stage Trim"; Bulletin 80.1: 010: Aug. 1997; pp. 1–6.

American Meter Company; "Radial Flow Valves" Aug. 1997; pp. 1–16.

Mooney Controls; "2–Flanged Single Port Flowgrid Valve"; 1991; pp. 1–6.

Pipe Line & Gas Industry magazine; "Testing evaluates ultrasonic meter installation configurations"; Dec. 2000; pp. 31–35.

Hydrocarbon Engineering; "Meeting Flow Conditions"; Jan. 2000; pp. 1–4.

American Gas Association; "Measurement of Gas by Multipath Ultrasonic Meters"; Jun. 2000.

American Gas Association; "Measurement of Gas by Turbine Engines"; Apr. 1996.

* cited by examiner

ADJUSTABLE FLOW DIFFUSER

CROSS-REFERENCE TO RELATED APPLICATION

This application is a continuation-in-part of Ser. No. 09/360,424 filed Jul. 23, 1999, now U.S. Pat. No. 6,289,934 issued on Sep. 18, 2001.

BACKGROUND OF THE INVENTION

1. Field of the Invention

The present invention relates to a flow diffuser with an elongate discharge nozzle which can be used as a 90° elbow in piping systems. The flow diffuser can be located in or immediately upstream of a measurement station or custody transfer station to improve measurement accuracy. The flow diffuser promotes laminar fluid flow and reduces pulsation in gas pipelines.

2. Description of the Prior Art

In piping systems, orderly or streamlined flow is desirable. When a fluid passes through a conventional valve or a 90° turn at a conventional elbow, the fluid flow becomes disorderly or turbulent. This turbulent fluid does not return to a streamlined or laminar flow for at least 40–50 pipe diameters downstream of an elbow. (Assuming that the downstream piping is axially aligned with the outlet of the valve or elbow and has the same inside diameter.)

Turbulence can be caused by a number of factors including, but not limited to, boundary layer separation, sometimes referred to as flow separation, vortices, pressure waves and/or cavitation. Turbulence in pipe systems often causes noise, vibration, erosion and/or stress cracking. Reduction of turbulence is desirable in valves, at elbows and in piping systems generally, both upstream of gas or liquid measurement and downstream of compressor stations.

Turbulence also causes a drop in fluid pressure. Each time a fluid flows through a valve or elbow, there is an incremental drop in fluid pressure between the inlet and the outlet. In transmission pipelines, pressure drops are undesirable. If the fluid pressure drops low enough, additional pumping stations may be required. In any event, adding pressure to the fluid in the pipeline increases transportation costs. Because the elbow of the present invention reduces turbulence, it has less of a pressure drop when compared with conventional 90° elbows.

Elbow induced turbulence has been recognized and addressed by a number of prior art designs including the vanes of U.S. Pat. No. 5,197,509 and No. 5,323,661 which are located upstream from an elbow. These vanes impart rotation to the fluid as it passes through the elbow to reduce downstream turbulence. Others have considered the deleterious effects of elbow induced turbulence and have included rotation vanes both upstream and downstream of an elbow as described in U.S. Pat. No. 5,529,084. These inventions seek to create non-turbulent or laminar flow after fluid passes through a conventional elbow.

The use of curved vanes to influence fluid flow for various reasons is not a new concept. In U.S. Pat. No. 1,570,907, a plurality of vanes were used in a locomotive to separate water from steam.

Japanese Patent Application Serial Number Sho58 (1983)-13899 was filed on Jan. 31, 1983 by Yamatake Honeywell Co. Ltd. for a Valve Seat for Control Valve and Its Manufacturing Method. This prior art valve discloses a comb-like cylinder equipped with multiple teeth of rectangular cross-section formed as one piece with the ring-shaped valve seat. These teeth may be formed at the lower end of the valve seat on the outlet side or may be formed at both the upper and the lower end of the valve seat. The manufacturing method of the valve seat occurs sequentially. First, multiple slits are formed in the radial direction on the cylindrical wall joined to the ring-shaped valve seat as one piece. Then the rectangular teeth forming these slits are twisted plastically (i.e., by exerting torsional moments at the tip of the teeth large enough to cause permanent deformation) so that each slit is oriented in the direction of the fluid flow at its respective position. Because of the rectangular shape of these teeth, they promote turbulence instead of encouraging laminar flow.

In some piping systems, granular or particulate material will quickly wear out a conventional elbow. One way to address this problem is by increasing the radius of curvature of the elbow to about 10 pipe diameters. However, this is not an entirely acceptable solution, especially in areas where space is at a premium. There have been many attempts to solve this erosion problem, including the use of inserts in the elbow, the insert being a disposable item intended to be replaced when it wears out. Examples of this type of replaceable insert in an elbow can be found in the following U.S. Pat. No. 1,357,259; No. 2,911,235; No. 3,942,684; and No. 5,590,916.

Other proposed solutions to this erosion problem include a circular pocket off the elbow. This pocket accumulates a certain quantity of the particulate material which serves as a pad to absorb the blow of the subsequent material to reduce the erosive effects thereof as shown in U.S. Pat. No. 4,387,914 and No. 5,060,984.

Conventional valves are also known to create turbulence and a pressure drop between the inlet and the outlet. Robert H. Welker, the inventor herein and the inventor of U.S. Pat. No. 5,730,416, has developed various approaches to deal with valve induced turbulence. In another patent, U.S. Pat. No. 5,769,388, Mr. Welker has developed a plurality of vanes and passageways in the valve to reduce turbulence. The apparatus shown in U.S. Pat. No. 5,769,388 has certain shortcomings because of the short discharge nozzle which tapered at an included angle of approximately 12°. There is still a need to reduce turbulence in elbows, in valves and in piping systems in general.

In a gas pipeline, pulsation is normally caused by reciprocating compressors and can be caused to a lesser degree by certain types of check valves. Pulsation in a gas pipeline is typically the result of the pistons in a reciprocating compressor pushing the gas out in distinct pressure waves which may move five to ten miles downstream of a pumping station. Pulsation is never desirable.

Liquid pipelines reduce pulsation by installing pulsation dampeners, many of which commercially available. Pulsation in a liquid pipeline can cause failure. The present invention should reduce pulsation in a liquid pipeline.

The present invention should also reduce pulsation in gas pipelines. Pulsation in gas pipelines can cause measurement error at custody transfer stations and other measurement installations. Pulsation pressure waves require sensitive instruments to be detected.

The traditional solution to reduce pulsation in a gas pipeline is a pulsation dampener, for example, those produced by Burgess Manning Corp. of Cisco, Tex. 76437.

Prior art pulsation dampeners typically cause at least a 15 psi permanent pressure drop in the pipeline. The present invention will reduce pulsation in a gas pipeline with only a nominal pressure drop, i.e., less than 5 psi.

BRIEF SUMMARY OF THE INVENTION

The present invention can be used as a 90° elbow in piping systems to reduce turbulence and pulsation. The elbow, sometimes referred to as a flow diffuser, is connected to an inlet conduit and an outlet conduit. The flow diffuser includes a convenient top entry design allowing access to the removable flow conditioner. Downstream of the flow conditioner is a transition zone, and an elongate tapered discharge nozzle. Fluid flows from the inlet conduit into the flow diffuser, through the flow conditioner, the transition zone, and the elongate tapered discharge nozzle to the outlet conduit.

The removable flow conditioner includes a plurality of vanes defining a plurality of passageways to guide the fluid flow from the inlet into the transition zone and elongate tapered discharge nozzle. The purpose of the guide vanes is to reduce asymmetric flow, swirling, jetting and other turbulence and to promote a symmetric velocity profile and/or laminar flow as the fluid turns a 90° corner. In gas pipelines, the vanes also reduce pulsation. The flow conditioner can be fabricated as a replaceable part to facilitate maintenance of the flow conditioner. One way to develop a symmetric velocity profile is the design of the vanes and passageways in the replaceable flow conditioner. The width of the outlets from the passageways may be non-uniform in order to promote streamlined flow.

After the flow diffuser has been fabricated, it is desirable to test and align the flow conditioner for maximum effectiveness before it is shipped to the field. This alignment process may only require minor adjustments to properly orient the flow conditioner relative to the discharge nozzle. After the adjustments have been made the flow conditioner will need to be locked in place. In some embodiments, the adjustment mechanism and the locking mechanism are separate structures. In one alternative embodiment with opposing set screws, the adjustment mechanism also locks the flow diffuser in place. In some situations it may also be desirable to further calibrate/adjust the flow diffuser in tandem with a meter after both have been installed in the field.

The flow diffuser can be used in piping systems with liquids, gases, and steam, as well as two-phase flow, three-phase flow, and dry particulate and granules.

BRIEF DESCRIPTION OF THE DRAWINGS

So that the manner in which the above-identified features and advantages of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and are therefore not to be considered limiting of its scope, for the invention may admit to other equally effective embodiments. Reference the appended drawings, wherein.

DETAILED DESCRIPTION OF THE INVENTION

Figure 1:
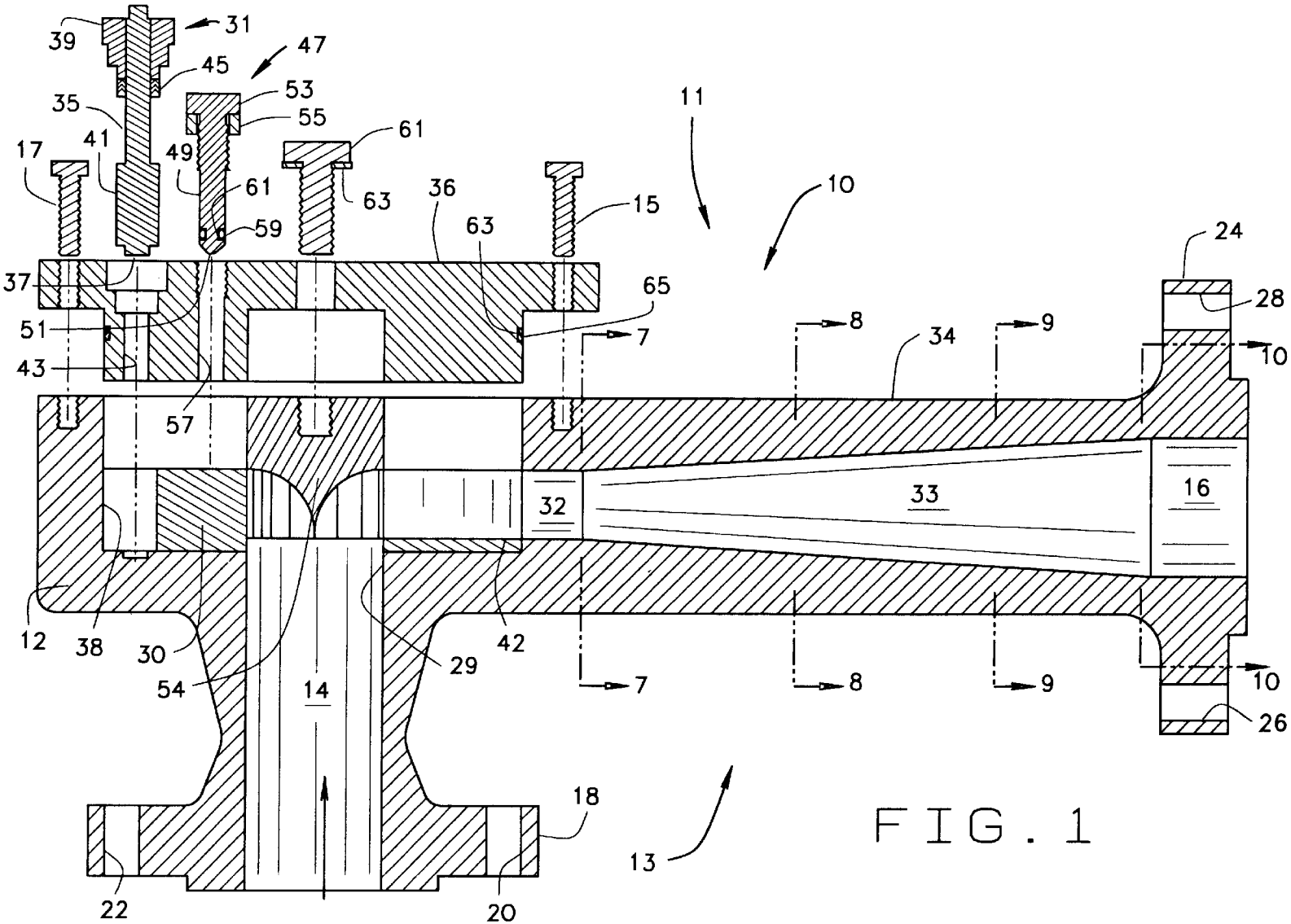
FIG. 1 is a section view of the flow diffuser in exploded view.

Referring now to FIG. 1, a flow diffuser is generally identified by the numeral 10 and is shown in exploded view. The top of the flow diffuser 10 is generally identified by the arrow 11 and the bottom is generally identified by its numeral 13. The flow diffuser is configured as a 90° elbow 10 to be used in a piping system, not shown. The flow diffuser 10 has a body 12 which defines an inlet 14 and an outlet 16. An inlet conduit, not shown in the drawing, has a flange that aligns and mechanically connects by a bolt circle to the inlet flange 18 of the elbow 10. The inlet flange 18 has a plurality of bolt holes, for example at 20 and 22 which receive the bolts for securing the inlet conduit flange to the inlet flange 18 of the flow diffuser 10. An outlet conduit, not shown in the drawing, has a flange which aligns and is connected to the outlet flange 24 of the flow diffuser 10 by a bolt circle. The outlet flange 24 of the flow diffuser 10 has a plurality of bolt holes, for example at 26 and 28 which align with the bolt holes in the outlet conduit flange. The alignment and connection of the inlet conduit flange and the outlet conduit flange to the flanges 18 and 24 of the elbow 10 in a piping system is well known to those skilled in the art.

To reduce turbulence and/or pulsation the inside diameter of the inlet 14 should be about the same as the inside diameter of the inlet conduit. To reduce turbulence and/or pulsation the inside diameter of the outlet 16 should be about the same as the inside diameter of the inlet conduit. To reduce turbulence and/or pulsation, the inside diameter of the outlet conduit should also be about the same as the inside diameter of the inlet conduit.

In FIG. 1 bolt holes 20, 22, 26 and 28 are shown at a 12 o'clock and 6 o'clock position merely for illustrative purposes. One skilled in the art will recognize that the actual locations of these bolt holes are out of hand about 16" from the position shown in these drawings for a 4-inch flange.

Fluid flows from the inlet conduit, not shown, into the inlet 14, past the throat 29, through the flow conditioner 30, into the transition zone 32, through the discharge passageway 33 of the elongate tapered discharge nozzle 34, through the outlet 16, and finally into the outlet conduit, not shown in the drawing. The present invention can reduce turbulence and/or pulsation in gas pipelines, such as those that transport natural gas and other hydrocarbons, and it can reduce turbulence in liquid pipelines such as those that transport water, gasoline, diesel and other hydrocarbons. It can be used for two-phase flow, such as a cold slurry or natural gas with entrained liquids. It can also be used with three-phase flow, such as oil, water and gas. It can be used with steam and it can be used with dry particulate or granules. For purposes of this application, all of the foregoing will simply be referred to as fluid.

The elbow 10 includes a removable cap 36. The cap 36 can be threadably attached to the body 12, or attached by other means well known in the art, such as a plurality of bolts 15 and 17. The elbow includes several primary components, as follows: a removable and adjustable flow conditioner 30, a transition zone 32, and a discharge passageway 33 in the elongate tapered discharge nozzle 34. The flow conditioner 30 is manufactured as a separate part that is inserted into receptacle 38 in the body 12 by removing the cap 36. Once the removable flow conditioner 30 is inserted into the receptacle 38 of the body 12, the cap 36 is replaced and secured. In some conditions, the flow conditioner may experience more wear than other components in the elbow 10. To facilitate maintenance and prolong the life of the flow diffuser 10, the flow conditioner is replaceable.

When fluid passes through a conventional 90° elbow in a piping system, turbulence is generated because of the 90° turn. Conventional wisdom indicates that laminar flow does not return to the fluid stream after it passes through a 90° elbow until as much as 40 to 50 pipe diameters past the elbow (assuming an axially aligned straight discharge pipe having the same inside diameters as the elbow). For example, with a conventional 2 inch elbow and 2 inch piping system, laminar flow may not return until as much as 80 inches to 100 inches downstream of the elbow. It is desirable for many reasons to restore laminar flow as quickly as possible after a fluid passes through a 90° elbow. A length of 40 or 50 pipe diameters is simply impractical in many real world applications.

The present invention restores substantially laminar flow to a fluid stream after it passes through the 90° turn within about 4 pipe diameters after the transition zone 32. Reducing the distance necessary to achieve substantially laminar flow from 40 or 50 pipe diameters to about 4 pipe diameters is an advantage in a number of situations, especially in close quarters, such as offshore drilling or production platforms. In addition, the flow diffuser 10 is able to restore laminar flow after the fluid passes through this 90° turn with reduced noise and vibration when compared with conventional elbow.

Reduction in noise and vibration is accomplished because of the reduced turbulence in the elbow 10 when compared with prior art elbows. Pulsation in gas pipelines is reduced because molecules entering the elbow at the same time arrive at the outlet at slightly different times due to some having to travel through a longer passageway (flow path). Therefore, the voids between pressure waves are filled in; thus, no pressure wave will exist at the outlet 16.

To function properly, the flow conditioner 30 must be aligned properly in the receptacle 38. An adjustment assembly generally identified by the numeral 31 allows proper alignment of the flow conditioner 30 with the discharge passageway 33 of the elongate tapered discharge nozzle 34. The adjustment assembly 31 includes an adjustment stem 35 with a pivot point 37 on one end and an adjustment knob 39 on the other end. A plurality of gear teeth 41 are formed on the stem 35 proximate the pivot point 37. The gear teeth 41 are sized and arranged to engage teeth 69 formed in the flow conditioner 30. Rotation of the knob 39 imparts rotation to the stem 35 and teeth 41 which engage the teeth 69 on flow conditioner 30. Thus, rotation of knob 39 causes the flow conditioner 30 to rotate in the receptacle 38. The stem 35 fits through a bore 43 in the cap 36 and is sealed by a plurality of chevron seals 45.

After proper adjustment of the flow conditioner 30, it is necessary in this embodiment to use a locking assembly 47 to lock the flow conditioner 30 in place. An elongate stem 49 has a point 51 on one end and a knob 53 on the other end. The point 51 bears against the flow conditioner 30 to lock it in the proper orientation. A lock nut 55 locks the stem 49 against the cap 36. The stem 49 fits through a bore 57 in the cap 36 and is sealed by an O-ring 59 which is positioned in groove 61.

Figure 2:
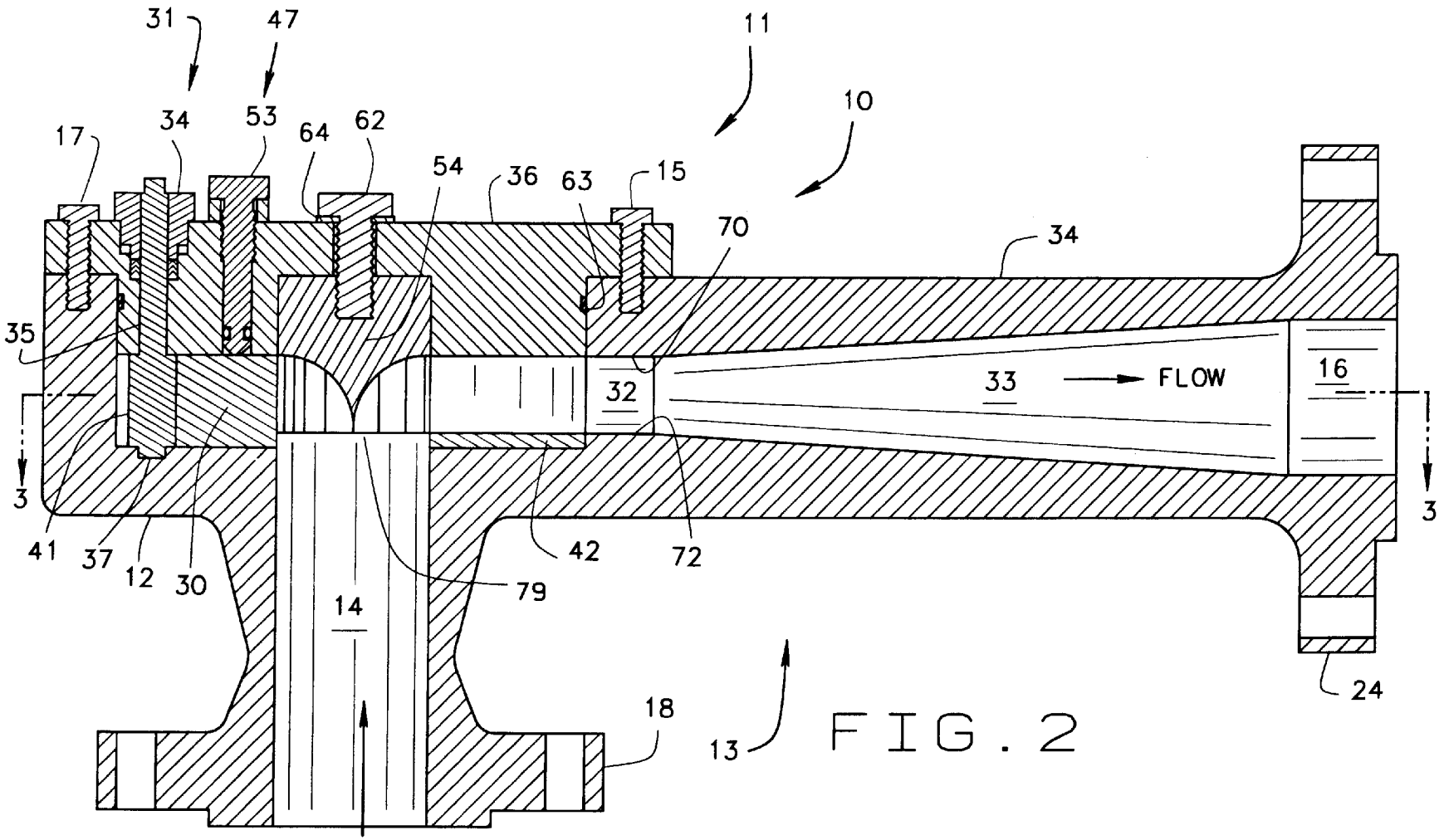
FIG. 2 is a section view of the flow diffuser of FIG. 1 fully assembled.

FIG. 2 is a section view of the flow diffuser 10 of FIG. 1, with the cap 36 and flow conditioner 30 assembled for operation. The flow conditioner 30 has a flat bottom plate 42. The guide vanes 50 A–P extend upward from the bottom 42 of flow conditioner 30. As a matter of manufacturing choice, it would be equivalent to invert the flow conditioner 30 so the vanes extended downward from a flat top plate, not shown. If the flow conditioner was produced in this equivalent fashion, minor changes would need to be made to the receptacle and cap so the conditioner would align with the transition zone 32 and the passageway 33 of elongate discharge nozzle 34. Body 12 forms a side wall 44 surrounding the flow conditioner 30. The side wall 44, the cap 36 and the bottom plate 42 contain the fluid flow in the flow conditioner 30. The flow conditioner 30 includes an inlet port and an outlet port identified generally by the dotted curved line 46 better seen in FIG. 3. The outlet port 46 is defined by the side wall 44, the cap 36 and the bottom surface 42 of the flow conditioner 30.

Figure 3:
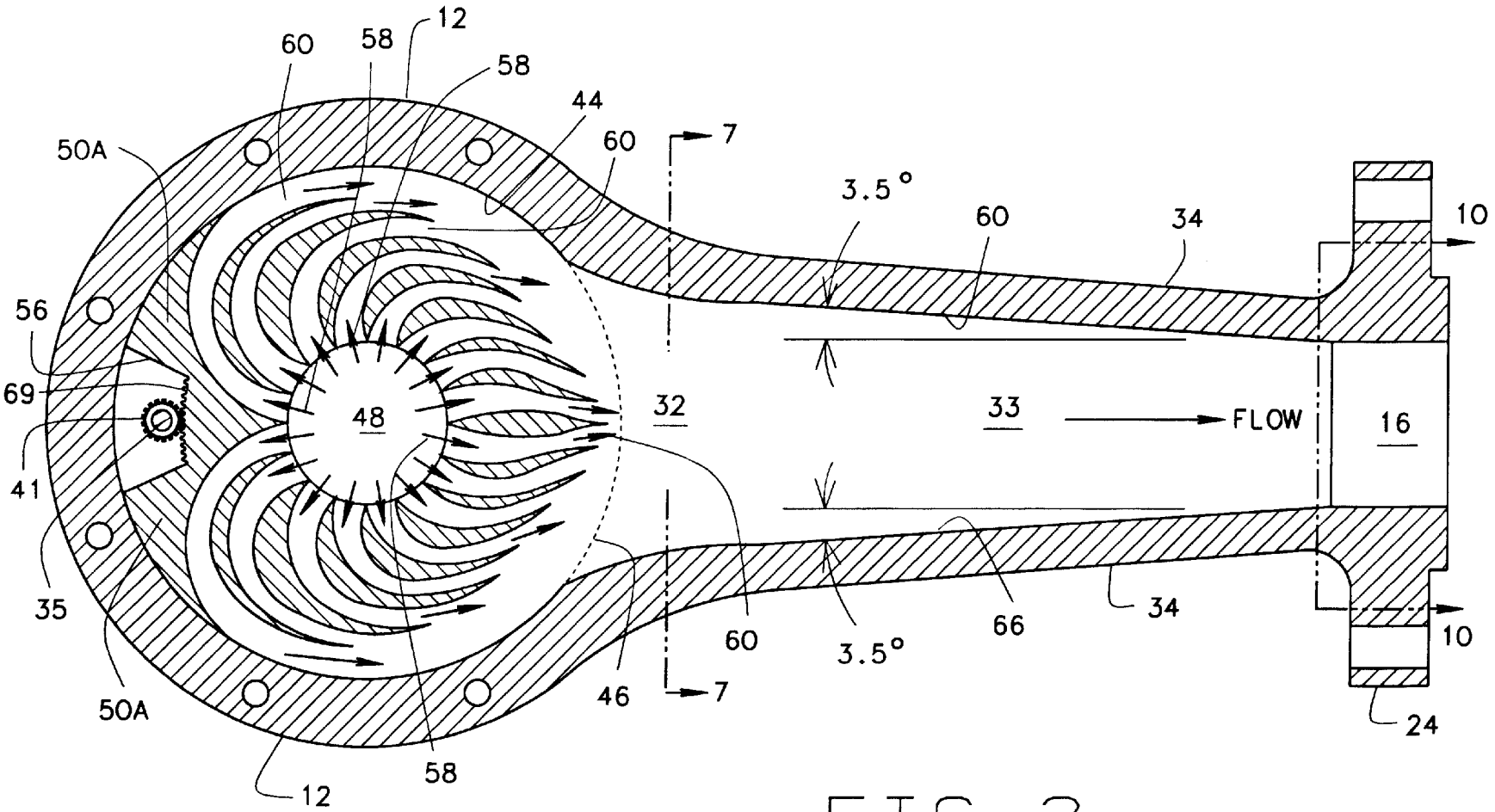
FIG. 3 is a section view of the flow diffuser along the line 3—3 of FIG. 2.

The inlet 14 feeds the fluid through an inlet port 79 into an inlet zone 48 better seen in FIG. 3. A generally conical protrusion 54 is attached to the cap 36 by bolt 62 which is sealed to cap 36 by seal 64. The conical protrusion 54 extends into the inlet zone 48 of flow conditioner 30. The area of the inlet zone 48 is reduced by the area of the generally conical protrusion 54; however, in the preferred embodiment, the inlet zone 48 has an area at least twice the cross-sectional area of the inlet 14. The conical protrusion 54 is replaceable, but as a matter of manufacturing choice, it would be equivalent to form the conical protrusion as a part of the cap 36 or as a part of the flow conditioner 30.

FIG. 3 is a section view of the flow diffuser 10 along the line 3—3 of FIG. 1 except the conical protrusion 54 is not shown. In other words, FIG. 3 is a section view of the flow diffuser 10 viewed from the top 11. The rear vane 50 A has a cutout area 56 and a plurality of teeth 69 formed therein. The teeth 41 formed on the stem 35 of the adjustment assembly 31 engage the teeth 69 on the rear vane 50 A of flow conditioner 30. Rotation of knob 39 causes stem 35 and teeth 41 to rotate. This imparts rotation to the flow conditioner 30 in receptacle 38. The flow conditioner 30 is adjusted after manufacture and before the flow diffuser 10 is shipped to the field.

Vanes 50 A–P define a plurality of passageways 52 A–P. In the preferred embodiment, 16 passageways are shown;

however, a larger number or a smaller number of passageways can be used depending on the fluid matrix, pressure, pipe size and other operational parameters. The side wall 44 of the body 12 together with the cap 36 and the bottom 42 direct fluid flow as it exits the passageways 52 A–P. The guide vanes have a generally heart-shaped outline. Each passageway 52 has a beginning 58 and an ending 60. The beginning 58 in fluid communication with the inlet zone 48 and the ending 60 is in fluid communication with the transition zone 32. In the preferred embodiment, the area of each beginning 58 has a cross-sectional area that is about twice as large as the cross-sectional area of the end 60. The width of each passageway 52 at the beginning 58 is preferably equal to the circumference of the inlet zone 48 divided by the number of passageways 52. The area of the beginning 58 and the end 60 of each passageway 52 may be modified during manufacture depending on the fluid matrix, pressure, pipe size and other operational parameters. The ends 60 of each passageway 52 A–P may have different widths in order to achieve the optimum velocity profile described in FIG. 15, below.

The taper of the discharge nozzle 34 is important to reduce turbulence of the fluid as it passes from the transition zone 32 towards the outlet conduit. Applicant prefers a taper with an included angle of about 5°–7.5°. The included angle of taper will determine the length of the discharge nozzle 34 as shown in the table below.

Discharge Nozzle Lengths

| Diameter of Inlet Conduit | 7° Included Angle | 5° Included Angle |
|---|---|---|
| 1" | App. 4.1" | App. 6.53" |
| 2" | App. 8.2" | App. 13.05" |
| 4" | App. 16.4" | App. 26.11" |
| 6" | App. 24.5" | App. 39.16" |
| 8" | App. 32.7" | App. 52.22" |
| 12" | App. 49.1" | App. 78.33" |

As indicated in this table, a discharge nozzle 34 tapered at a 7° included angle will have a length approximately 4 times the diameter of the inlet conduit. A discharge nozzle tapered at a 5° angle will be longer and have a length approximately 6½ times the diameter of the inlet conduit.

As shown in FIG. 3, the interior surface 66 of the discharge nozzle 34 has a taper of 3.5° on all surfaces as measured from lines extended parallel to the outlet conduit. The tapered discharge nozzle 34 extends from the line 7—7 to the line 10—10. The parallel lines in the drawing extend parallel to the walls of the outlet 16. The outlet 16 has parallel sides aligned with the outlet conduit to reduce turbulence.

Figure 4:
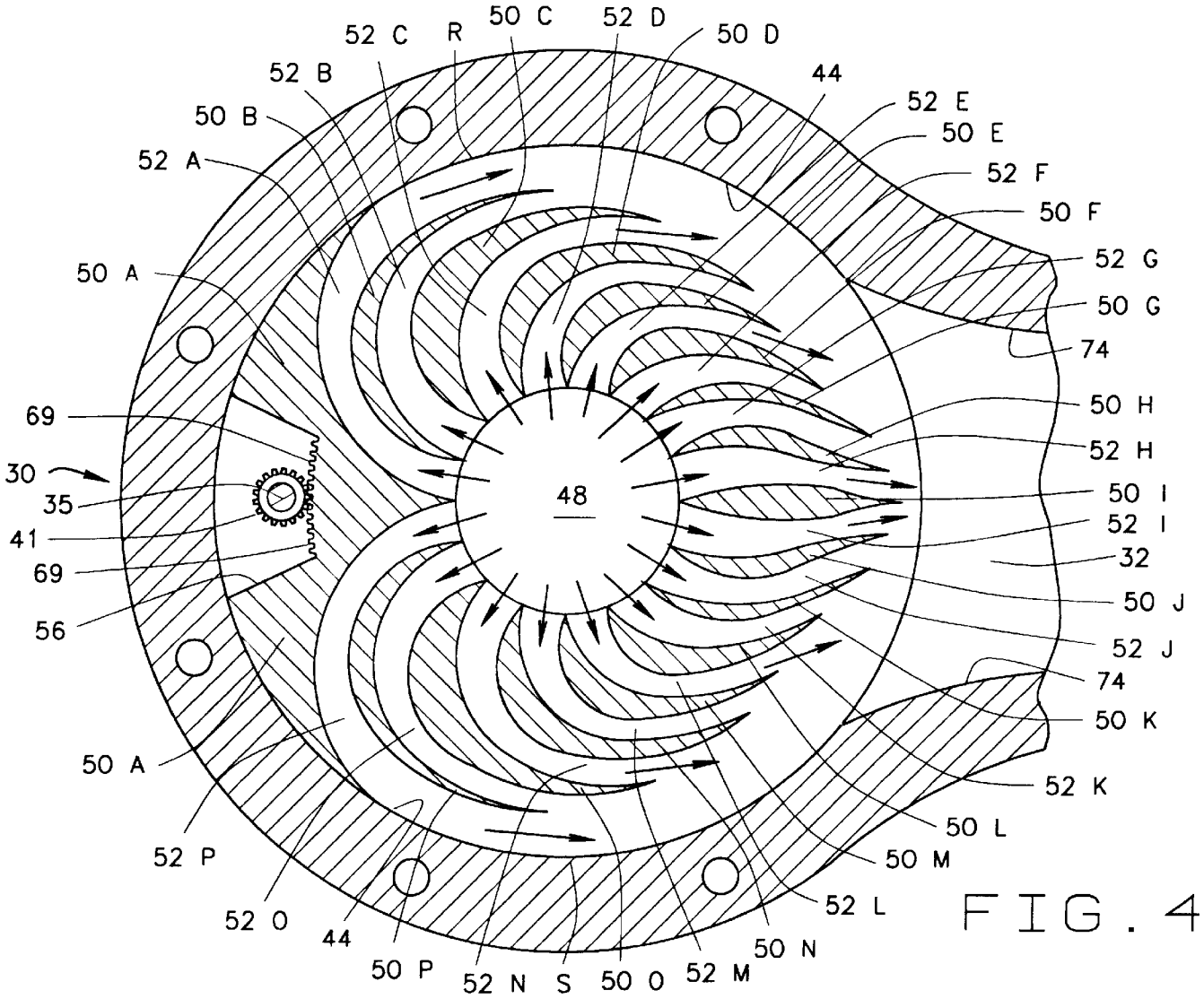
FIG. 4 is an enlarged partial section view of the adjustable flow conditioner, vanes and passageways of FIG. 3.

In FIG. 4, an enlarged section view of the flow conditioner 30 similar to the view in FIG. 3 without the conical protrusion 54. Fluid flows form the inlet 14 into the inlet zone 48 which has a larger area than the cross-sectional area of the inlet 14. The fluid encounters the conical protrusion 54, the guide vanes 50 A–P and the beginning 58 of each curvilinear passageway 52 A–P as shown by the flow arrows. The fluid then passes through the passageways 52 A–Q and moves into the transition zone generally identified by the numeral 32. The transition zone 32 is defined by an upper portion 70 and a lower portion 72 of the body 12 and a curved outer wall 74, which is likewise a portion of the body 12. In the preferred embodiment, the curved outer wall 74 has a radius about 2½ times the diameter of the inlet 14. The transition zone 32 is in fluid communication with the outlet opening 46 of the flow conditioner 30, and the elongate tapered discharge nozzle 34. The diameter of the flow conditioner from point R to point S in the preferred embodiment is approximately 3 times the diameter of the inlet 14.

Some of the passageways, i.e., 52 H and 52 I are aligned radially relative to the inlet zone 48 and some are curvilinear, i.e., 52 A and 52 P. This combination of radial and curvilinear passageways reduces turbulence as fluid passes through the flow diffuser 10. In addition, all of the vanes 50 A–50 P have a streamlined leading edge 81 and a streamlined trailing edge 83 which also reduces turbulence as fluid passes through the flow diffuser 10.

Figure 5:
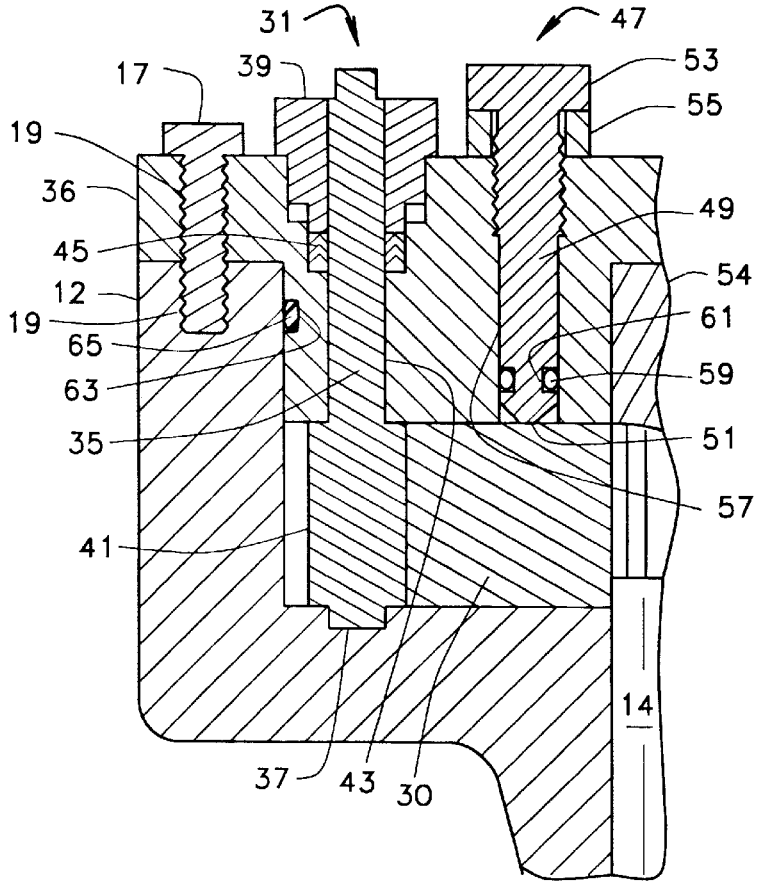
FIG. 5 is an enlarged partial section view of the adjustment assembly, the locking assembly, and the adjustable flow conditioner of FIG. 2.

FIG. 5 is an enlarged section view of the adjustment assembly 31 and the locking assembly 47. The removable cap 36 is attached to the body 12 by a plurality of bolts. Bolt 17 passes through bore 19 in cap 36 and threadibly engages bore 21 in body 12. In this view, the point 51 of stem 49 is in engagement with the top surface of the rear vane 50 A of the flow conditioner 30 to hold it in a fixed position. Lock nut 55 is abutting cap 36, thus holding the stem 49 in a locked position. An O-ring groove 63 surrounds the cap 36. O-ring 65 is positioned in the groove 63 to form a seal between the body 12 and the removable cap 36. Chevron seals 45 form a seal between the stem 35 and the bore 43 of the cap 36. O-ring 59 forms a seal between the stem 49 and the bore 57 of the cap 36. Adjustment of the flow conditioner 30 occurs after the diffuser 10 has been manufactured but before it has been shipped to the field.

Figure 6:
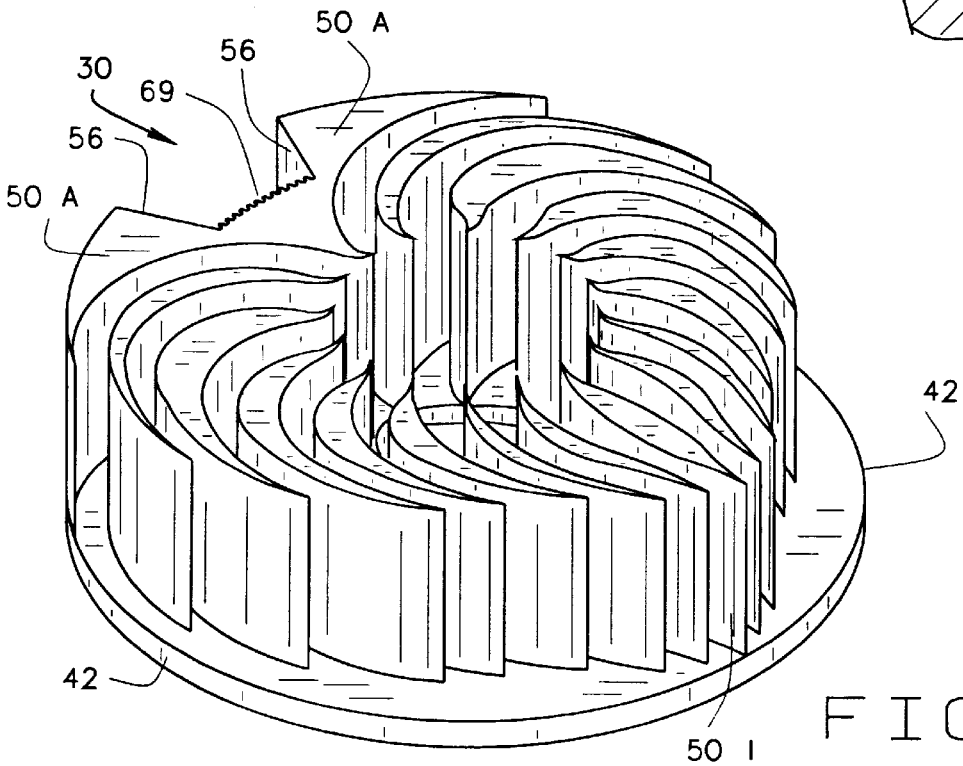
FIG. 6 is an enlarged perspective view of the removable flow conditioner of FIG. 3.

FIG. 6 is a perspective view of the top side of the removable flow diffuser 30. Vanes 50 A–P extend upward from a flat bottom plate 42. Teeth 69 are formed in a cutout 56 in the rear vane 50 A. The center vane 50 I is located opposite the rear vane 50 A.

Figure 7:
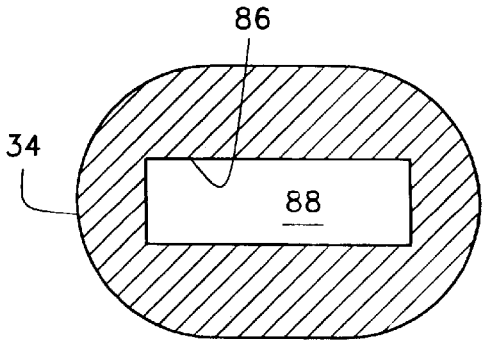
FIG. 7 is a section view of the rectangular inlet of the discharge passageway in the elongate discharge nozzle at the line 7—7 of FIG. 1.

FIG. 7 is a section view of the discharge nozzle 34 along the line 7—7 of FIG. 1. The interior surface 86 of the discharge nozzle 34 defines a discharge passageway 33 with a generally rectangular shaped inlet 88. In the preferred embodiment, the height of the rectangular shaped inlet 88 is about ½ the diameter of the inlet 14 and the width of the rectangular inlet 88 is about 1.5 times the diameter of the inlet 14. However, other dimensional configurations for this rectangle fall within the scope of this invention and may be adjusted, depending upon the fluid matrix, pressure, pipe size, and other operational parameters.

Figure 8:
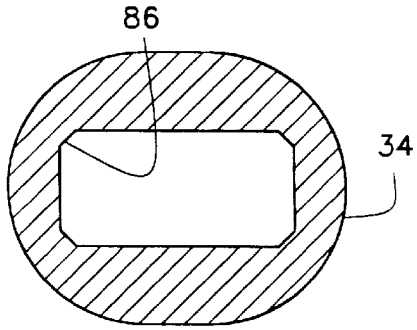
FIG. 8 is a section view of the polygonal interior surface of the discharge passageway in the elongate discharge nozzle at the line 8—8 of FIG. 1

FIG. 8 is a section view of the discharge nozzle 34 along the line 8—8 of FIG. 1. The interior surface 86 begins to change shape from the generally rectangular inlet 88 to a polygon as shown in the drawing. Other polygonal shapes fall within the scope of this invention, provided that the interior surface 86 maintains a taper with an included angle of about 5°–7.5°.

Figure 9:
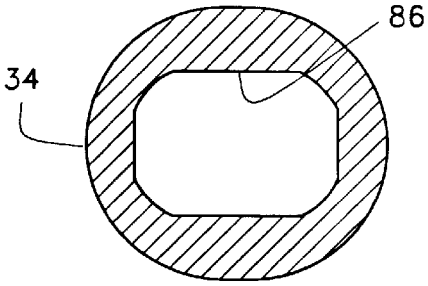
FIG. 9 is a section view of the polygonal interior surface of the discharge passageway in the elongate discharge nozzle at the line 9—9 of FIG. 1.

FIG. 9 is a section view of the discharge nozzle 34 along the line 9—9 of FIG. 1. The interior surface 86 is polygonal. Other polygonal shapes fall within the course of this invention, provided that they are tapered as discussed above.

Figure 10:
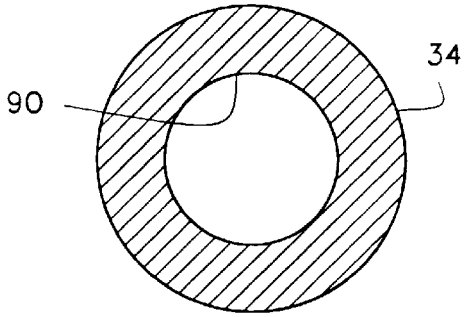
FIG. 10 is a section view of the circular outlet of the discharge passageway in the elongate discharge nozzle at the line 10—10 of FIG. 1.

FIG. 10 is a section view along the line 10—10 of FIG. 1 showing the discharge nozzle 34 as it converges to a circular outlet 90. The diameter of the circular outlet 90 is approximately equal to the diameter of the inlet 14. The inlet conduit and the outlet conduit should be approximately equal in diameter and cross-sectional area to reduce turbulence. The cross-sectional area of the discharge passageway 33 as it extends from line 7—7 to line 10—10 for a 7° included angle is about 4 times the diameter of the inlet 14. The length of the discharge nozzle 34 from the line 7—7 to the line 10—10 with a 5° included angle is about 6½ times the diameter of the inlet 14. FIG. 10 the elbow 10 is viewed from the bottom 13.

Figure 11:
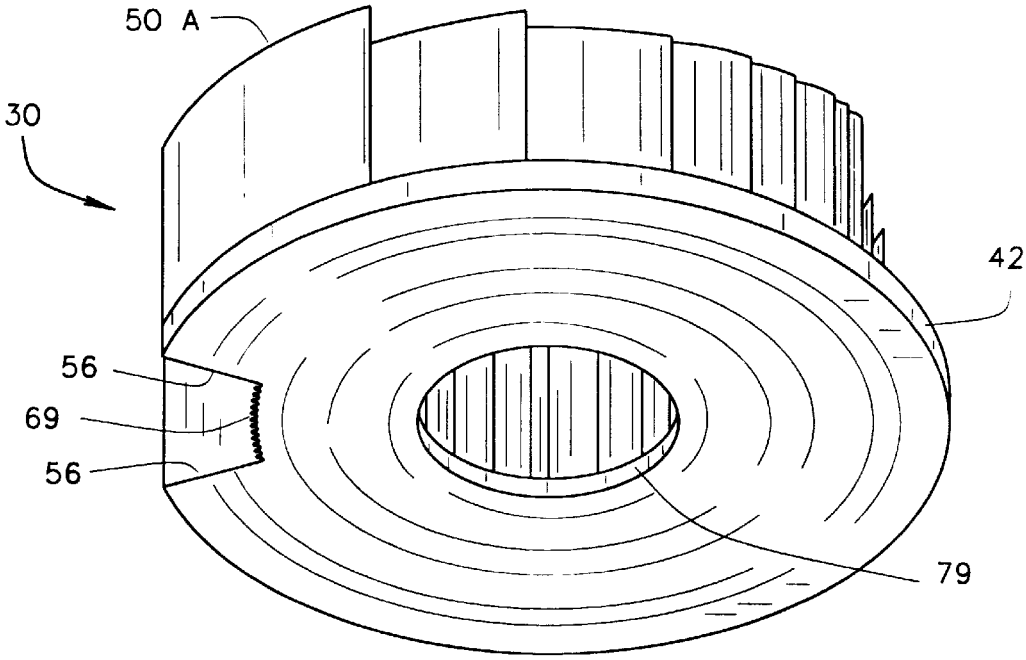
FIG. 11 is an enlarged perspective view of the bottom of the removable flow conditioner of FIG. 3.

FIG. 11 is a bottom perspective view of the removable flow conditioner 30. The vanes 50 A–P extend upward from the flat bottom plate 42. An inlet port 79 is formed in the bottom plate 42. In the rear of the flow conditioner 30 is the rear vane 50 A. A cutout 56 is formed in the rear vane 50 A and the bottom plate 42. Teeth 69 are formed in the cutout 56 to permit adjustment of the flow conditioner 30.

Figure 12:
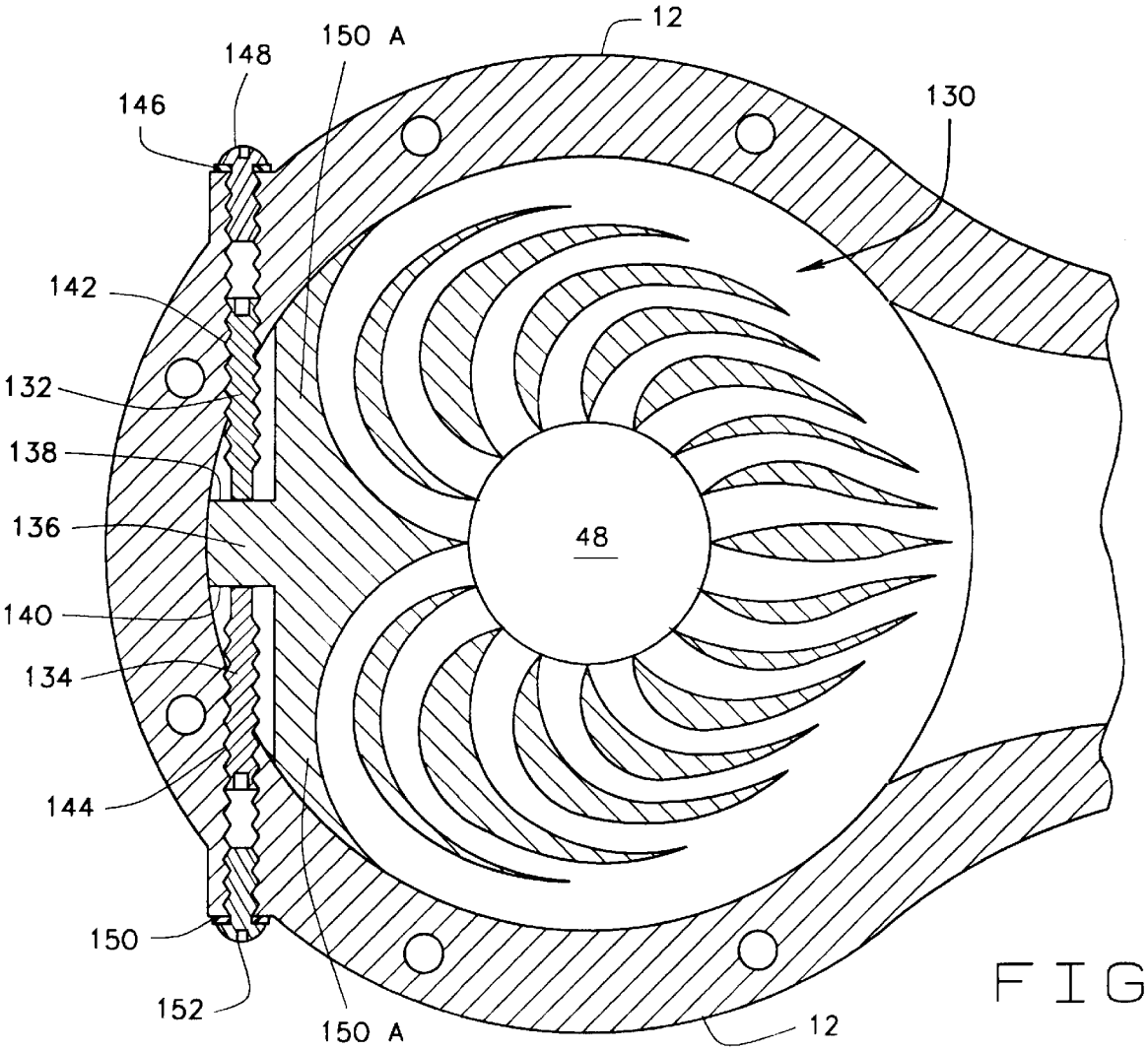
FIG. 12 is an enlarged partial section view of an alternative embodiment of the adjust assembly using opposing set screws to rotate the flow conditioner.

FIG. 12 is an alternative embodiment of the adjustment assembly. In this alternative embodiment of the adjustment assembly, no separate locking assembly is needed, because opposing set screws 132 and 134 are self locking.

In FIG. 12 a modified flow diffuser 130 has a lug 136 formed on the rear vane 150 A. Set screw 132 engages one side 138 of the lug 136 and set screw 134 engages the other side 140 of the lug 136. The set screw 132 threadibly engages bore 142 in the body 12 and set screw 134 threadibly engages bore 144 in the body 12. When set screw 132 is turned clockwise and set screw 134 is turned counter-clockwise, the flow diffuser 130 rotates counter-clockwise, and vice versa.

A seal 146 surrounds the head of screw 148 and creates a seal between the body 12 and the screw 148. The screw 148 must be removed from bore 142 in order to rotate the set screw 132. A seal 150 surrounds the head of screw 152 and creates a seal between the body 12 and the screw 152. The screw 152 must be removed from bore 144 in order to rate the set screw 134.

Figure 13:
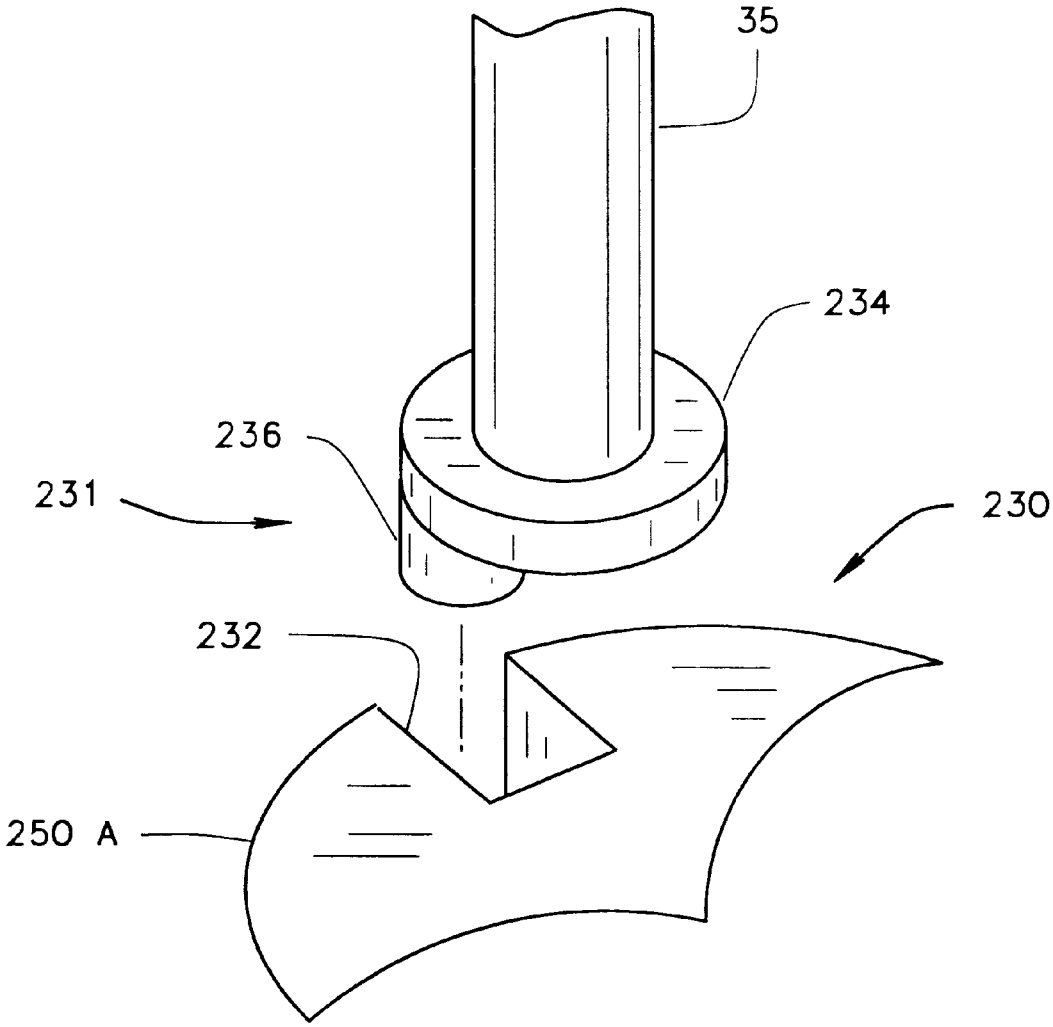
FIG. 13 is an enlarged perspective view of an alternative embodiment of the adjustment mechanism using an eccentric cam.

FIG. 13 is a second alternative embodiment of the adjustment assembly. In the second alternative embodiment of the adjustment assembly 231, a separate locking mechanism must be used to fix the position of the flow conditioner 230.

In FIG. 13, a modified flow conditioner 230 has a slot 232 formed in the rear vane 250 A. The stem 35 has an eccentric cam 234 formed on the end opposite the knob 39. A projection 236 extends from the eccentric cam 234 and engages the slot 232 in the rear vane 250 A. When the knob 39 is rotated clockwise, the projection 236 bears against slot 232, causing the flow conditioner 230 to rotate clockwise and vice versa.

Figure 14:
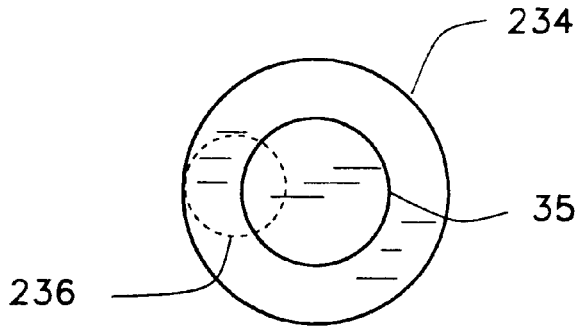
FIG. 14 is a top view of the eccentric cam.

FIG. 14 is a top view of the eccentric cam 234. The projection 236 is shown in phantom.

Figure 15:
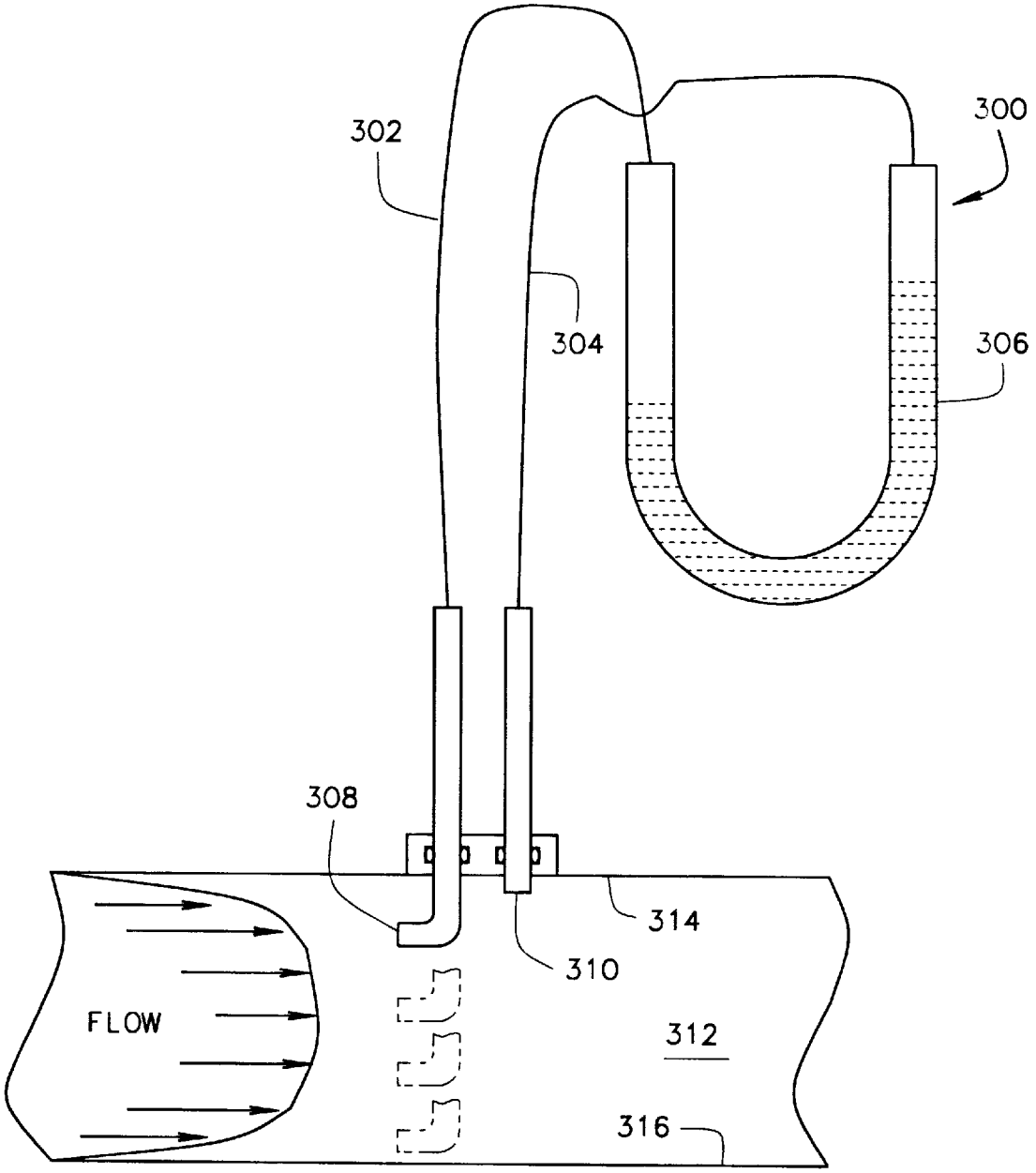
FIG. 15 is a schematic view of the test apparatus used during the adjustment process for the flow diffuser.

FIG. 15 is a schematic of the test apparatus used to adjust the flow conditioner after manufacture, but before it is shipped to the field. A newly manufactured flow diffuser 10 is placed approximately six pipe diameters upstream of the manometer 300 and is connected to a pressurized source of fluid, not shown. A shut off valve, not shown, is placed between the source of pressurized fluid and the flow diffuser 10. A valve, not shown, is opened and pressurized fluid flows through the flow diffuser 10 past the manometer 300. The flow conditioner 30 is rotated using the adjustment mechanism 31 based on the readout from the manometer 300. After precise alignment is achieved, the locking assembly 47 is secured and the flow conditioner 30 is fixed in position. The flow diffuser 10 is then ready to be shipped to the field for installation.

This final adjustment process is necessary because there may be slight manufacturing imperfections in the flow conditioner 30 which might create a bias in the fluid flow exiting the flow conditioner 30. Another reason for this final adjustment process is because precise prealignment of the flow conditioner 30 with the passageway 33 in the elongate discharge nozzle 34 during manufacture is difficult because the flow conditioner 30 is removable. Prior art prealignment pins simply do not always achieve the desired precision due to manufacturing tolerances and assembly requirements. Precise alignment can be achieved when fluid is passing through the flow diffuser 10. Adjustments to the flow conditioner 30 are typically very slight, and may only be 0.010 inch in one direction or the other.

The manometer 300 has a high pressure side 302 and a low pressure side 304. In between is a U-shaped tube 306 typically filed with water. The normal readout from a manometer is in inches of water.

The high pressure side 302 is attached to an adjustable pitot probe 308 that can be moved up and down through the center of the pipeline as shown in phantom. The low pressure side 304 is connected to an inlet 310 that is fixed in position near the wall of the pipeline.

The goal of the adjustment procedure is to achieve a symmetric velocity profile in the flowing fluid downstream of the flow diffuser 10. The shape of a symmetric velocity profile is sketched in FIG. 15.

If the flow diffuser is inefficient or improperly adjusted, asymmetric and/or turbulent fluid flow may result. Asymmetric and turbulent flow are undesirable. If the adjustment procedure is not precise, the velocity profile may be flattened or there may be overrounding, both of which are undesirable. Overrounding results in a conical velocity profile which is sometimes referred to as a jet.

The American Gas Association (AGA) has various accuracy standards for flow meters. Asymmetric flow, jetting, swirling and/or pulsations may adversely affect accurate flow measurement. According to AGA Transmission Measurement Committee Report No. 9 at Section 7.2.2 "asymmetric velocity profiles may persist for 50 pipe diameters downstream from the point of initiation. Swirling velocity profiles may persist for 20 pipe diameters or more." The present invention is designed to produce a symmetric velocity profile without swirling or jetting. One way to enhance measurement accuracy is to use a sufficient length of straight pipe (i.e., diameters) upstream of the meter so the fluid will develop a symmetric velocity profile before it enters the meter. Another way to enhance measurement accuracy is to place a well designed flow diffuser upstream of the meter so the fluid will develop a symmetric velocity profile before it enters the meter. Various flow diffusers (also called flow conditioners) are available for this purpose, such as the Vortab from Vortab Company of San Marcos, Calif.; the CPA 50E plate from Canadian Pipeline Accessories Company, Ltd. of Calgary, Alberta, Canada; or the GFC (Gallagher Flow Conditioner) from Savant Measurement Corp. of Kingwood, Tex.

The adjustment procedure for the present invention using the apparatus in FIG. 15 is as follows. First, the pitot probe 308 is placed in the center 312 of the pipe to measure the pressure of the flowing fluid in the center of the pipe. Then the pitot probe 308 is placed near each pipe wall 314 and 316 to measure the pressure of the flowing fluid near the walls. The highest pressure should be in the center 312 of the pipeline and the lowest pressures should be near the walls 314 and 316.

A symmetric velocity profile is desirable and has the same velocity on either side of the center-line of the pipe. The optimum velocity profile has a gentle curve or rounded nose as shown in FIG. 15. The adjustable pitot probe 308 is moved back and forth across the diameter of the pipeline from wall 314 to wall 316 to measure the velocity of the flowing fluid. The flow conditioner 30 should be adjusted so the velocity profile is as close as possible to the optimum shape shown in FIG. 15. After adjustment, the flow conditioner 30 should be locked in place with the locking mechanism 47. In some situations, it may also be desirable to further calibrate/adjust the flow diffuser 10 in tandem with a meter after both have been installed in the field.

Similar adjustments can be made to the flow conditioner 130 with the first set screws 132 and 134 in the first alternative embodiment of FIG. 12, except there is no separate locking assembly. In other words, the opposing set screws 132 and 134 can be tightened against the lug 136 to lock the flow conditioner 130 in place.

Similar adjustments can also be made to the flow conditioner 230 with eccentric cam 234 in the second alternative embodiment shown in FIGS. 13 and 14. In the second alternative embodiment a separate locking assembly 47 is required to fix the position of the flow conditioner 230.

In some situations it may be difficult to obtain a pressurized fluid source to adjust the flow conditioners 30, 130 or 230. In these situations, the center vane 50 I may be optically aligned with the center of the passageway 30 of the elongate discharge nozzle 34.

What is claimed is:

1. An adjustable diffuser connected to an inlet conduit and an outlet conduit to reduce turbulence and/or pulsation as fluid flows from the inlet conduit through the diffuser to the outlet conduit, the adjustable diffuser comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet;

the flow conditioner having a plate with a plurality of vanes defining a plurality of flow passageways so that an exit flow path from all the passageways is oriented generally towards the elongate discharge nozzle and outlet; and an adjustment assembly to rotate and precisely align the flow conditioner, the vanes and the flow passageways relative to the discharge passageway in the elongate discharge nozzle and the outlet.

2. The apparatus of claim 1 further including a lock assembly to fix the position of the flow conditioner after the flow conditioner, the vanes and the flow passageways have been precisely aligned with the elongate discharge nozzle and outlet.

3. The apparatus of claim 2 wherein the adjustment assembly includes:

a plurality of gear teeth formed in the flow conditioner;

an elongate adjustment stem having a plurality of adjustment stem gear teeth on one end and an adjustment knob on the other end so rotation of the adjustment knob causes rotation of the adjustment stem gear teeth; and the adjustment stem gear teeth engage the gear teeth in the flow conditioner so rotation to the adjustment knob on the adjustment stem causes rotation of the flow conditioner to precisely align the vanes and the curvilinear passageways with the elongate discharge nozzle and the outlet.

4. The apparatus of claim 2 wherein the lock assembly includes:

an elongate lock pin sized and arranged to fit in an elongate bore in the cap; and the lock pin threadibly engaging the bore so rotation of the pin imparts axial movement to the lock pin causing it to move away from or to engage with the flow conditioner to lock the flow conditioner in position when the vanes and curvilinear passageways are precisely aligned with the elongate discharge nozzle and the outlet.

5. An adjustable diffuser connected to an inlet conduit and an outlet conduit to reduce turbulence and/or pulsation as fluid flows from the inlet conduit through the diffuser to the outlet conduit, the adjustable diffuser comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet;

the flow conditioner having a plate with a plurality of vanes defining a plurality of flow passageways so that an exit flow path from all the passageways is oriented generally towards the elongate discharge nozzle and outlet;

an adjustment assembly to rotate and precisely align the flow conditioner, the vanes and the flow passageways relative to the discharge passageway in the elongate discharge nozzle and the outlet; and said adjustment assembly having a pair of opposing axial elongate set screws bearing against opposing sides of an adjustment lug extending from the removable flow diffuser, the elongate set screws threadibly engaging the body so rotation of one elongate set screw and counter-rotation of the opposing set screw, causes movement of the adjustment lug and the removable flow diffuser.

6. An adjustable diffuser connected to an inlet conduit and an outlet conduit to reduce turbulence and/or pulsation as fluid flows from the inlet conduit through the diffuser to the outlet conduit, the adjustable diffuser comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet;

the flow conditioner having a plate with a plurality of vanes defining a plurality of flow passageways so that an exit flow path from all the passageways is oriented generally towards the elongate discharge nozzle and outlet; and an adjustment assembly to rotate and precisely align the flow conditioner, the vanes and the flow passageways relative to the discharge passageway in the elongate discharge nozzle and the outlet;

a lock assembly to fix the position of the flow conditioner after the flow conditioner, the vanes and the flow passageways have been precisely aligned with the elongate discharge nozzle and outlet;

said adjustment assembly having a slot formed in the removable flow diffuser; and, an elongate adjustment stem having an eccentric cam on one end and an adjustment knob on the other end, the eccentric cam engaging the slot in the removable flow diffuser so rotation of the adjustment knob causes rotation of the eccentric cam which imparts rotation to the removable flow diffuser.

7. The apparatus of claim 6 wherein the lock assembly includes:

an elongate lock pin sized and arranged to fit in an elongate bore in the cap;

the lock pin threadibly engaging the bore so rotation of the pin imparts axial movement to the lock pin causing it to move away from or to engage with the flow conditioner to lock the flow conditioner in position when the vanes and curvilinear passageways are precisely aligned with the elongate discharge nozzle and the outlet.

8. An adjustable diffuser connected to an inlet conduit and an outlet conduit to reduce turbulence and/or pulsation as fluid flows from the inlet conduit through the diffuser to the outlet conduit, the adjustable diffuser comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet conduit;

the flow conditioner having a plate with a plurality of vanes defining a plurality of flow passageways, some of the flow passageways having a curvilinear orientation and some having a generally radial orientation so that the fluid flowing from all the passageways is directed generally towards the elongate discharge nozzle and outlet; and an adjustment assembly to rotate the flow conditioner to precisely align fluid flow from the flow passageways to the discharge passageway in the elongate discharge nozzle and the outlet.

9. The apparatus of claim 8 further including a lock assembly to fix the position of the flow conditioner after fluid flow has been precisely aligned with the elongate discharge nozzle and outlet.

10. The apparatus of claim 9 wherein the adjustment assembly includes:

a plurality of gear teeth formed in the flow conditioner;

an elongate adjustment stem having a plurality of adjustment stem gear teeth on one end and an adjustment knob on the other end so rotation of the adjustment knob causes rotation of the adjustment stem gear teeth; and the adjustment stem gear teeth engage the gear teeth in the flow conditioner so rotation to the adjustment knob on the adjustment stem causes rotation of the flow conditioner to precisely align the fluid flow from the curvilinear passageways with the elongate discharge nozzle and the outlet.

11. The apparatus of claim 9 wherein the lock assembly includes:

an elongate lock pin sized and arranged to fit in an elongate bore in the cap;

the lock pin threadibly engaging the bore so rotation of the pin imparts axial movement to the lock pin causing it to move away from or to engage with the flow conditioner to lock the flow conditioner in position when fluid flow from the curvilinear flow passageways is precisely aligned with the elongate discharge nozzle and the outlet.

12. An adjustable diffuser connected to an inlet conduit and an outlet conduit to reduce turbulence and/or pulsation as fluid flows from the inlet conduit through the diffuser to the outlet conduit, the adjustable diffuser comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet conduit;

the flow conditioner having a plate with a plurality of vanes defining a plurality of flow passageways, some of the flow passageways having a curvilinear orientation and some having a generally radial orientation so that the fluid flowing from all the passageways is directed generally towards the elongate discharge nozzle and outlet; and an adjustment assembly to rotate the flow conditioner to precisely align fluid flow from the flow passageways to the discharge passageway in the elongate discharge nozzle and the outlet;

the apparatus of claim 8 further including a lock assembly to fix the position of the flow conditioner after fluid flow has been precisely aligned with the elongate discharge nozzle and outlet; and the lock assembly includes:

an elongate lock pin sized and arranged to fit in an elongate bore in the cap;

the lock pin threadibly engaging the bore so rotation of the pin imparts axial movement to the lock pin causing it to move away from or to engage with the flow conditioner to lock the flow conditioner in position when fluid from the curvilinear flow passageways is precisely aligned with the elongate discharge nozzle and the outlet.

13. An adjustable diffuser connected to an inlet conduit and an outlet conduit to reduce turbulence and/or pulsation as fluid flows from the inlet conduit through the diffuser to the outlet conduit, the adjustable diffuser comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet conduit;

the flow conditioner having a plate with a plurality of vanes defining a plurality of flow passageways, some of the flow passageways having a curvilinear orientation and some having a generally radial orientation so that the fluid flowing from all the passageways is directed generally towards the elongate discharge nozzle and outlet; and an adjustment assembly to rotate the flow conditioner to precisely align fluid flow from the flow passageways to the discharge passageway in the elongate discharge nozzle and the outlet;

a lock assembly to fix the position of the flow conditioner after fluid flow has been precisely aligned with the elongate discharge nozzle and outlet; and the adjustment assembly having a slot formed in the removable flow diffuser; and, an elongate adjustment stem having an eccentric cam on one end and an adjustment knob on the other end, the eccentric cam engaging the slot in the removable flow diffuser so rotation of the adjustment knob causes rotation of the eccentric cam which imparts rotation to the removable flow diffuser.

14. The apparatus of claim 13 wherein the lock assembly includes:

an elongate lock pin sized and arranged to fit in an elongate bore in the cap;

the lock pin threadibly engaging the bore so rotation of the pin imparts axial movement to the lock pin causing it to move away from or to engage with the flow conditioner to lock the flow conditioner in position when the vanes and curvilinear passageways are precisely aligned with the elongate discharge nozzle and the outlet.

15. An adjustable diffuser connected to an inlet conduit and an outlet conduit to reduce turbulence and/or pulsation as fluid flows from the inlet conduit through the diffuser to the outlet conduit comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet;

the flow conditioner having a plate with a plurality of vanes defining a plurality of flow passageways so that an exit flow path from all the passageways is oriented generally towards the elongate discharge nozzle and outlet; and an adjustment assembly to rotate the flow conditioner and precisely align the center vane with the discharge passageway in the elongate discharge nozzle and the outlet.

16. The apparatus of claim 15 further including a lock assembly to fix the position of the flow conditioner after the center vane in the flow conditioner has been precisely aligned with the elongate discharge nozzle and outlet.

17. The apparatus of claim 16 wherein the adjustment assembly includes:

a plurality of gear teeth formed in the flow conditioner;

an elongate adjustment stem having a plurality of adjustment stem gear teeth on one end and an adjustment knob on the other end so rotation of the adjustment knob causes rotation of the adjustment stem gear teeth; and the adjustment stem gear teeth engage the gear teeth in the flow conditioner so rotation to the adjustment knob on the adjustment stem causes rotation of the flow conditioner to precisely align the center vane with the elongate discharge nozzle and the outlet.

18. The apparatus of claim 16 wherein the lock assembly includes:

an elongate lock pin sized and arranged to fit in an elongate bore in the cap;

the lock pin threadibly engaging the bore so rotation of the pin imparts axial movement to the lock pin causing it to move away from or to engage with the flow conditioner to lock the flow conditioner in position when the center vane is precisely aligned with the elongate discharge nozzle and the outlet.

19. An adjustable diffuser connected to an inlet conduit and an outlet conduit to reduce turbulence and/or pulsation as fluid flows from the inlet conduit through the diffuser to the outlet conduit, the adjustable diffuser comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet conduit;

the flow conditioner having a plate with a plurality of vanes defining a plurality of flow passageways, some of the flow passageways having a curvilinear orientation and some having a generally radial orientation so that the fluid flowing from all the passageways is directed generally towards the elongate discharge nozzle and outlet; and an adjustment assembly to rotate the flow conditioner and precisely align the center vane with the discharge passageway in the elongate discharge nozzle and the outlet;

said adjustment assembly having a pair of opposing axial elongate set screws bearing against opposing sides of an adjustment lug extending from the removable flow diffuser, the elongate set screws threadibly engaging the body so rotation of one elongate set screw and counter-rotation of the opposing set screw, causes movement of the adjustment lug and the removable flow diffuser.

20. An adjustable diffuser connected to an inlet conduit and an outlet conduit to reduce turbulence and/or pulsation as fluid flows from the inlet conduit through the diffuser to the outlet conduit comprising:

a body defining an inlet, a receptacle, an elongate discharge nozzle, and an outlet;

a cap removeably attached to the body, the cap allowing access to the receptacle;

a removable flow conditioner sized and arranged to fit in the receptacle, fluid flowing from the inlet conduit into the flow conditioner, through the elongate discharge nozzle to the outlet;

the flow conditioner having a plate with a plurality of vanes defining a plurality of flow passageways to that an exit flow path from all the passageways is oriented generally towards the elongate discharge nozzle and outlet; and an adjustment assembly to rotate the flow conditioner and precisely align the center vane with the discharge passageway in the elongate discharge nozzle and the outlet;

a lock assembly to fix the position of the flow conditioner after the center vane in the flow conditioner has been precisely aligned with the elongate discharge nozzle and outlet;

said adjustment assembly having a slot formed in the removable flow diffuser; and an elongate adjustment stem having an eccentric cam on one end and an adjustment knob on the other end, the eccentric cam engaging the slot in the removable flow diffuser so rotation of the adjustment knob causes rotation of the eccentric cam which imparts rotation to the removable flow diffuser.

21. The apparatus of 20 wherein the lock assembly includes:

an elongate lock pin sized and arranged to fit in an elongate bore in the cap; and the lock pin threadibly engaging the bore so rotation of the pin imparts axial movement to the lock pin causing it to move away from or to engage with the flow conditioner to lock the flow conditioner in position when the vanes and curvilinear passageways are precisely aligned with the elongate discharge nozzle and the outlet.

* * * * *